US009546796B2

(12) United States Patent
DiFulgentiz, III

(10) Patent No.: US 9,546,796 B2
(45) Date of Patent: Jan. 17, 2017

(54) EXTERNAL BODY TEMPERATURE SENSOR FOR USE WITH A HVAC SYSTEM

(71) Applicant: Lennox Industries Inc., Richardson, TX (US)

(72) Inventor: Robert Anthony DiFulgentiz, III, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 408 days.

(21) Appl. No.: 13/920,497

(22) Filed: Jun. 18, 2013

(65) Prior Publication Data

US 2014/0367079 A1 Dec. 18, 2014

(51) Int. Cl.
*F24F 11/00* (2006.01)

(52) U.S. Cl.
CPC ..... *F24F 11/0034* (2013.01); *F24F 11/006* (2013.01); *F24F 11/0086* (2013.01); *F24F 2011/0036* (2013.01); *F24F 2011/0068* (2013.01)

(58) Field of Classification Search
CPC .... F24F 11/0034; F24F 11/006; F24F 11/0086
USPC ..... 700/276
See application file for complete search history.

(56) References Cited

U.S. PATENT DOCUMENTS 5,100,053 A * 3/1992 Manson ..... G05D 23/1902 236/47
2004/0065098 A1* 4/2004 Choi ..... F24F 11/0034 62/180
2005/0245839 A1* 11/2005 Stivoric ..... G06F 19/3418 600/549
2007/0100666 A1* 5/2007 Stivoric ..... A61B 5/0008 705/3
2008/0114495 A1* 5/2008 Suyama ..... B60H 1/00642 700/276
2009/0065596 A1* 3/2009 Seem ..... F24F 11/0009 236/51
2011/0115635 A1* 5/2011 Petrovski ..... A47C 21/044 340/584
2011/0272131 A1* 11/2011 Mikat ..... B60H 1/00742 165/202
2012/0186774 A1* 7/2012 Matsuoka ..... G05B 15/02 165/11.1
2014/0180480 A1* 6/2014 Lee ..... F24F 11/0009 700/275
2014/0207292 A1* 7/2014 Ramagem ..... G05B 15/02 700/278

OTHER PUBLICATIONS

Choi, Joon Ho, "CoBi: Bio-Sensing Building Mechanical System Controls for Sustainably Enhancing Individual Thermal Comfort" (May 2010). Dissertations, pp. 131-132. Paper 33 (Retrieved from <<http://repository.cmu.edu/cgi/viewcontent.cgi?article=1035&context=dissertations>> on Jan. 22, 2016).*

* cited by examiner

*Primary Examiner* — Kenneth M Lo
*Assistant Examiner* — Michael J Huntley
(74) *Attorney, Agent, or Firm* — Winstead PC

(57) ABSTRACT

A HVAC system is provided. In one embodiment, the HVAC system includes (1) a sensor being configured to measure a body condition of a user and having a transmitter configured to wirelessly transmit body condition information, and (2) a HVAC controller having a receiver configured to receive the body condition information and being configured to adjust a current conditioning set point of the HVAC system to a temporary conditioning set point based on the body condition information.

21 Claims, 2 Drawing Sheets

EXTERNAL BODY TEMPERATURE SENSOR FOR USE WITH A HVAC SYSTEM

TECHNICAL FIELD

This application is directed, in general, to heating, ventilating and air conditioning (HVAC) systems and, more specifically, to a HVAC system having a remote sensor device and a controller device.

BACKGROUND

Heating, ventilating and air conditioning (HVAC) systems are used to regulate the environment within an enclosed space for the comfort of an occupant. Typically, the thermostat of the HVAC system regulates the environment by measuring the ambient condition and treating the air based on the measured ambient condition. For example, if the measured ambient temperature is out of the range set by the occupant of the HVAC system, the thermostat assumes that the occupant is uncomfortable and instructs the demand unit of the HVAC system to condition (e.g., cool or heat) the air to meet the set range.

SUMMARY

One aspect provides a HVAC system. In one embodiment, the HVAC system includes (1) a sensor being configured to measure a body condition of a user and having a transmitter configured to wirelessly transmit body condition information of the user, and (2) a HVAC controller having a receiver configured to receive the body condition information and being configured to adjust a current conditioning set point of the HVAC system to a temporary conditioning set point based on the body condition information.

In another aspect, a sensor device for a HVAC system is provided. In one embodiment, the sensor device includes (1) a sensor configured to measure a body condition of a user, and (2) a transmitter configured to wirelessly transmit body condition information of the user to an associated HVAC controller for adjusting a current conditioning set point of an associated HVAC system to a temporary conditioning set point based on the body condition information.

In yet another aspect, a HVAC controller device is provided. In one embodiment, the controller includes (1) a receiver configured to wirelessly receive body condition information of a user, and (2) a controller configured to adjust a current conditioning set point of an associated HVAC system to a temporary conditioning set point based on the body condition information.

BRIEF DESCRIPTION

Reference is now made to the following descriptions taken in conjunction with the accompanying drawings, in which.

DETAILED DESCRIPTION

Determining a comfort level of an occupant within an air conditioned enclosed space based on the measured ambient condition is not always accurate because it does not consider a body condition of the occupant. For example, even when the ambient condition of an enclosed area is maintained at the set point values, the occupant may still feel uncomfortable if the occupant is engaged in an intense workout, doing household chores, such as cleaning or vacuuming, or simply not wearing appropriate clothing, etc. Thus, to accurately determine the comfort level of an occupant, the occupant's condition information, such the external body temperature, the heart rate, preparation levels, etc., of the occupant should be considered, in addition to the ambient condition.

Disclosed herein is a sensor for use with a HVAC system that accurately determines an occupant's comfort level by taking a direct measurement of a body condition of the occupant. Instead of placing a point of measurement within a given enclosed air space, the disclosed sensor reads the occupant's body condition by placing the sensor on the skin or clothing of the occupant, or at least in close proximity to the occupant (such as provided by infrared sensors) for a more direct and accurate measurement of the occupant's body condition. The disclosed sensor uses this measurement to make an accurate determination of the occupant's comfort level and, based on that determination, it communicates with a controller of a HVAC system to adjust a set point of that HVAC system.

Figure 1:
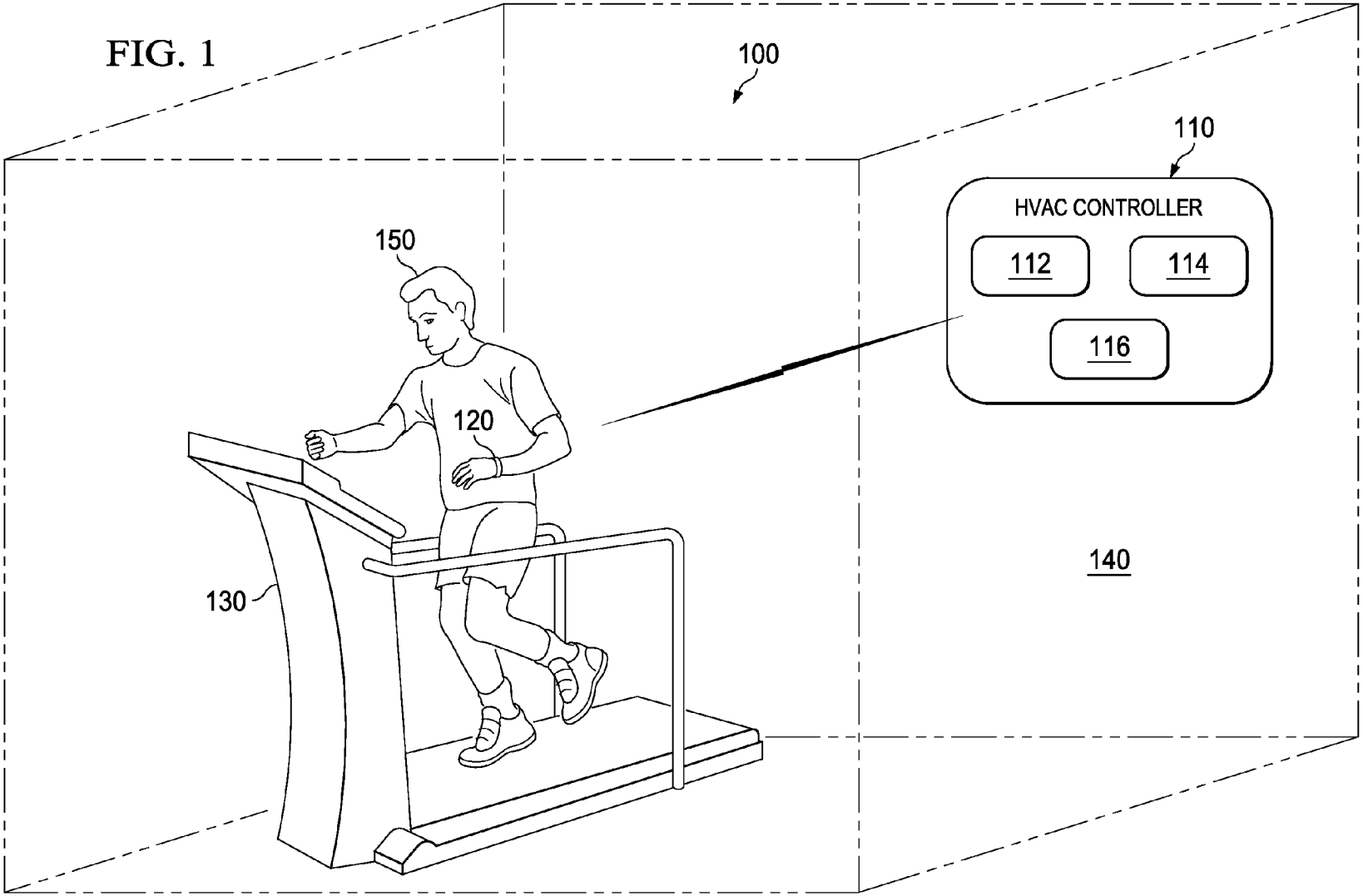
FIG. 1 illustrates an example of an embodiment of an HVAC system that is constructed according to the principles of the disclosure.

FIG. 1 illustrates an example of an embodiment of an HVAC system 100 with which the sensor, as provided by embodiments of this disclosure, may be employed. The HVAC system 100 is a networked HVAC system configured to control the environmental condition of an enclosed area 140. The system 100 includes a HVAC controller 110, a sensor device 120 and an optional intermediary equipment 130. The controller 110, sensor device 120 and the optional intermediary equipment 130 are configured to communicate with each other to maximize the comfort level of an occupant 150 in the enclosed area 140.

Although not shown, the system 100 includes one or more furnaces, one or more refrigerant evaporator coils and one or more air handlers for conditioning the environmental condition of the enclosed area 140. For convenience in the following discussion, a demand unit is representative of the various units exemplified by the air handler, furnace, refrigerant evaporator coil, and more generally an HVAC component that provides an air conditioning service in response to a control signal sent by the controller 110. The service may be, e.g., heating, cooling, humidification, dehumidification, or air circulation.

In one embodiment, the HVAC controller 110 comprises a receiver unit 112, a processor 114 and a user interface 116. The controller 110 is configured to receive various body condition information of the occupant 150 measured by the sensor device 120 via the receiver unit 112. The controller 110 is also configured to adjust, based on the received condition information, the current conditioning set points of the system 100 for the enclosed area 140 to maximize the comfort level of the occupant 150.

In one embodiment, the sensor device 120 is a wrist band worn around the wrist of the occupant 150. However, in other embodiments, the sensor device 120 may be an infrared sensor that can be placed near the occupant 150. The sensor device 120 is configured to measure a body condition of the occupant 150, and transmit the measured condition information wirelessly to the receiver unit 112 of the controller 110. In one embodiment that utilizes the intermediary equipment 130, the sensor device 120 may be configured to transmit the measured condition information wirelessly to the intermediary equipment 130. In this embodiment, the intermediary equipment 130 (such as a treadmill or weight machine, etc.) is configured to transmit the received condition information wirelessly to the receiver unit 112 of the controller 110 for possible adjustment of the current conditioning set points. As noted above, it should be understood that the occupant's body condition may change in other ways. For example, the occupant may be doing household chores, such as cleaning, vacuuming, or exercising without using any intermediary equipment 130.

Figure 2:
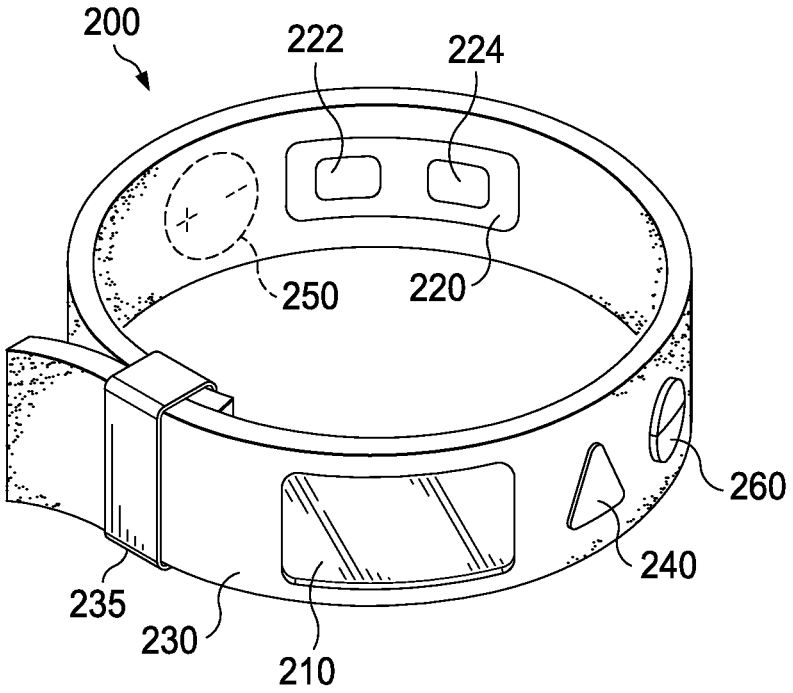
FIG. 2 is an example of an embodiment of a sensor device for a HVAC system constructed according to the principles of the disclosure.

FIG. 2 is a high-level block diagram of an embodiment of a sensor device 200 for a HVAC system constructed according to the principles of the disclosure. In this embodiment, the sensor device 200 is a wrist band. The sensor device 200, however, is not limited to a wrist band. The sensor device 200 can be any apparatus that can be worn on other locations of the occupant or may be separated from the occupant. For example, in some embodiments, the sensor device 200 may be an arm band, a head band, an ankle band, or a chest band. In yet other embodiments, the senor 200 may not be in direct contact with the occupant at all. As noted above, the senor 200 may be an infrared sensor that is capable of measuring a body condition, such as external body temperature, of the occupant from a distance. The infrared sensor may be free standing or mounted in the occupied space either on the wall or on the optional intermediary equipment, as shown in FIG. 1.

In the embodiment where the sensor 200 is a wrist band, the sensor device 200 includes a display 210, a sensor 220, a band body 230, a transmitter unit 240, and a battery 250. The display 210 is located on the outer side of the band body 230 and configured to display an external body temperature or other body condition of the occupant. Such information includes the current skin/surface temperature, perspiration level, heart rate and so on.

In the illustrated embodiment, the sensor 220 is located on the inner side of the band body 230. The sensor 220 is configured to measure various conditions of the occupant such as the occupant's skin/surface temperature, perspiration level, heart rate and so on. In this embodiment, the sensor 220 includes a temperature sensor 222 and a perspiration sensor 224. In one embodiment, at least one of the temperature and perspiration sensors 222 and 224 is in physical contact with the occupant for measurement.

In another embodiment, the temperature sensor 222 is not in physical contact with the occupant, but is positioned in close proximity of the occupant. In such embodiments, the temperature sensor 222 may be an infrared detector, such as a temperature gun, a thermal radiation thermometer, etc.

The band body 230 is typically ring-shaped so that it can be worn around a wrist or ankle of an occupant. The shape of the band body 230, however, is not limited to a ring shape. The band body 230 also includes a buckle or clasp 235 for adjusting the length thereof so that the sensor device 200 can be worn by occupants of varying sizes. The band body 230 can be made of any water-resisting elastic material. In one embodiment, the band body 230 is made of rubber.

The transmitter unit 240 is located in the outer side of the band body 230. The transmitter unit 240 includes a transmitter and an antenna. The transmitter unit 240 is configured to sync with an associated HVAC controller and to wirelessly transmit the condition information measured by the sensor 220 to the associated HVAC controller. The transmitter unit 240 becomes synced with the associated HVAC controller when the sensor device 200 is turned on or reset. In an embodiment that has multiple HVAC controllers, the sensor device 200 may be configured to detect and sync with a HVAC controller that has the strongest signal when the sensor device 200 is turned on or reset or loses synchronization with the current controller. In another embodiment that also has multiple HVAC controllers, the sensor device 200 may be equipped with a GPS and be configured to sync with a HVAC controller that is closest to the sensor device 200 when the sensor device 200 is turned on or reset or loses synchronization with the current controller.

In some embodiments, the sensor device 200 may be configured to sync with a remote central server such as a satellite that can relay the measured occupant condition information to environment controller units that are located outside the building the associated HVAC system is installed. For example, when the occupant leaves the house and drives to work, the remote central server will relay the measured occupant condition information to the climate control unit in the occupant's car while the occupant is driving and to the HVAC controller in the occupant's work when the occupant arrives at the work.

In one embodiment, the transmitter 240 is configured to transmit the occupant condition information periodically such as every 30 or 60 seconds. In some embodiments, the transmitter 240 is configured to transmit the occupant condition information when there is a change in the occupant's condition. The transmitter unit 240 is configured to transmit the occupant's condition information wirelessly using a technology such as BLUETOOTH™, ZIGBEE®, or WIFI®.

The sensor device 200 includes a battery 250. The battery 250 can be a disposable kind of various sizes. The batteries can also be a secondary or rechargeable kind of various sizes. In some embodiments, the sensor device 200 can use kinetic energy and be motion or momentum-powered.

The sensor device 200 also includes a power switch/button 260. The power switch 260 is located in the outer side of the band body 230. In one embodiment, the sensor device 200 is manually turned on or off by switching/pressing the power switch/button 260. In some embodiments that the power switch/button 260 is synced with the sensor 220, the power switch/button 260 can turn the sensor device 200 on and off automatically. For example, when the sensor device 200 is synced with an optional motion sensor (not shown), the power switch/button 260 can turn the sensor device on when the motion detector detects a motion for a predefined period of time, and the power switch/button 260 can turn the sensor device 200 off when the motion detector does not detect any motion for a predefined time period.

In other embodiments, the power switch/button 260 is configured to turn the sensor device 200 off when the measured condition information is outside a predefined range. For example, the power switch/button 260 can turn the sensor device 200 off when the measured surface temperature of the occupant goes outside the predefined range or when the sensor 220 is not in physical contact with the occupant for a predefined period of time. These features not only conserve the battery 250 of the sensor device 200, but also indicate that the sensor device 200 is no longer in use and the HVAC system can return to the scheduled set point values.

Figure 3:
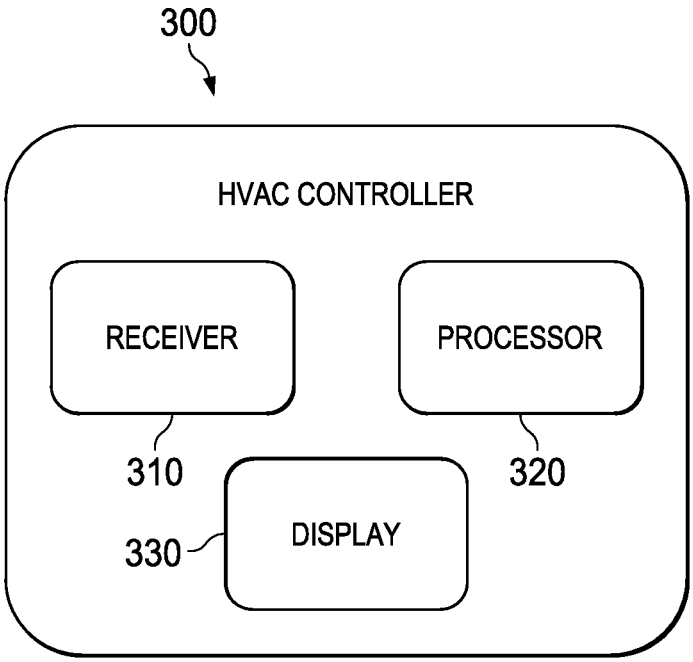
FIG. 3 is a high-level block diagram of an embodiment of a HVAC controller device constructed according to the principles of the disclosure.

FIG. 3 is a high-level block diagram of an embodiment of a HVAC controller device 300 constructed according to the principles of the disclosure. The controller 300 comprises a receiver 310, a processor 320 and a display 330. The controller 300 may be located anywhere in the building that the HVAC system is applied as long as the receiver 310 can receive the signal from the sensor device of the HVAC system. In one embodiment, the receiver 310, processor 320 and display 300 are enclosed together and in other embodiments, they are scattered throughout the building.

The receiver 310 is configured to wirelessly receive the measured condition information from the sensor devices. In one embodiment, the received condition information may be an analog signal. In such embodiments, the controller 300 will include an optional Analog to Digital converter for converting the signal into digital signal. The measured condition information may include the occupant's skin/surface temperature, perspiration level, heart rate, and so on.

The processor 320 is operatively coupled to the receiver 310 and configured to adjust the current conditioning set points of the HVAC system for the enclosed area to temporary conditioning set points based on the measured occupant condition information. The conditioning set points include temperature, humidity, and fan level set points. For example, when the measured condition information, such as the skin/surface temperature or perspiration level, is above the predefined range, the processor 320 will temporarily lower the current temperature and humidity set points and raise the current fan level set point. And when the measured condition information is below the predefined range, the processor 320 will temporarily raise the current temperature set point.

The processor 320 is further configured to adjust the temporary conditioning set points back to the scheduled conditioning set points when the receiver 310 fails to receive the condition information from the sensor device for a predefined time, i.e., when the sensor device is off. For example, if the receiver 310 fails to receive the signal for more than two minutes, then the processor adjust the conditioning set points back to the scheduled set points.

Those skilled in the art to which this application relates will appreciate that other and further additions, deletions, substitutions and modifications may be made to the described embodiments.

What is claimed is:

1. A HVAC system comprising:

a sensor being configured to measure a body condition of a user and having a transmitter configured to wirelessly transmit body condition information of said user;

a HVAC controller having a receiver, wherein the HVAC controller is configured to receive said measured perspiration level;

determine whether the received perspiration level is above a predefined range;

responsive to a determination that the received perspiration level is above the predefined range, adjust a current conditioning set point of said HVAC system to a temporary temperature set point that is lower than the current conditioning set point;

responsive to a determination that the received perspiration level is below the predefined range, adjust the current conditioning set point of said HVAC system to the temporary temperature set point that is higher than the current conditioning set point; and adjust said temporary temperature set point back to said current conditioning set point based on criteria relative to said received perspiration level.

2. The HVAC system of claim 1, wherein said sensor is in physical contact with said user.

3. The HVAC system of claim 1, wherein said sensor further includes a turn off switch that turns said sensor off when said measured perspiration level is outside a predefined range.

4. The HVAC system of claim 1, wherein said sensor further includes a turn off switch that turns said sensor off when said sensor is not in physical contact with said user for a predefined period of time.

5. The HVAC system of claim 1, wherein said transmitter transmits said measured perspiration level wirelessly using at least one of following technologies:

BLUETOOTH™;

ZIGBEE®; and

WIFI®.

6. The HVAC system of claim 1, wherein said sensor is powered using at least one of: kinetic energy; and electrical energy.

7. The HVAC system of claim 1, wherein said criteria comprises said measured perspiration level being outside the predefined range.

8. The HVAC system of claim 1, wherein said criteria comprises said receiver failing to receive said measured perspiration level for a predefined period of time.

9. The HVAC system of claim 1, wherein said sensor comprises at least one of:

a wrist band;

an arm band;

a head band;

an ankle band; and a chest band.

10. A body condition sensor device for use with a heating ventilation air condition (HVAC) system, comprising:

a sensor configured to measure a perspiration level of a user occupying an enclosed space;

a transmitter configured to wirelessly transmit said measured perspiration level of said user to an associated HVAC controller for adjusting a current conditioning set point of an associated HVAC system to a temporary temperature set point based on said measured perspiration level;

wherein the HVAC controller is configured to:

determine whether the perspiration level is above a predefined range;

responsive to a determination that the perspiration level is above the predefined range, adjust the current conditioning set point of said HVAC system to the temporary temperature set point that is lower than the current conditioning set point;

responsive to a determination that the perspiration level is below the predefined range, adjust the current conditioning set point of said HVAC system to the temporary temperature set point that is higher than the current conditioning set point; and adjust said temporary temperature set point back to said current conditioning set point based on criteria relative to said measured perspiration level.

11. The sensor device of claim 10, wherein said sensor is in physical contact with said user.

12. The sensor device of claim 10 further comprising a turn off switch that turns said sensor device off when said measured perspiration level is outside of the predefined range.

13. The sensor device of claim 10 further comprising a turn off switch that turns said sensor device off when said sensor is not in physical contact with said user for a predefined period of time.

14. The sensor device of claim 10, wherein said transmitter transmits said measured perspiration level wirelessly using at least one of following technologies:

BLUETOOTH™;

ZIGBEE®; and

WIFI®.

15. The sensor device of claim 10, wherein said sensor device comprises at least one of:

a wrist band;

an arm band;

a head band;

an ankle band; and a chest band.

16. The sensor device of claim 10, wherein said sensor device is powered using at least one of:

kinetic energy; and electrical energy.

17. A HVAC controller device comprising:

a receiver configured to wirelessly receive a perspiration level of a user;

a processor configured to adjust a current conditioning set point of an associated HVAC system to a temporary temperature set point based on said received perspiration level;

wherein the processor is further configured to:

determine whether the perspiration level is above a predefined range;

responsive to a determination that the perspiration level is above the predefined range, adjust the current conditioning set point of said HVAC system to the temporary temperature set point that is lower than the current conditioning set point;

responsive to a determination that the perspiration level is below the predefined range, adjust the current conditioning set point of said HVAC system to the temporary temperature set point that is higher than the current conditioning set point; and adjust said temporary temperature set point back to said current conditioning set point based on criteria relative to said received perspiration level.

18. The HVAC controller device of claim 17, wherein said criteria comprises said received perspiration level being outside the predefined range.

19. The HVAC controller device of claim 17, wherein said criteria comprises said receiver failing to receive said perspiration level for a predefined period of time.

20. The sensor device of claim 10, wherein said criteria comprises said measured perspiration level being outside the predefined range.

21. The sensor device of claim 10, wherein said criteria comprises a receiver of said HVAC controller failing to receive said measured perspiration level for a predefined period of time.

* * * * *